US005120118A

United States Patent [19]

Rankin

[11] Patent Number: 5,120,118

[45] Date of Patent: Jun. 9, 1992

[54] FREEZER HAVING INDIVIDUAL PULL-OUT DRAWERS

[76] Inventor: Charles P. Rankin, P.O. Box 546, Columbia, Miss. 39429

[21] Appl. No.: 645,254

[22] Filed: Jan. 24, 1991

Related U.S. Application Data

[63] Continuation of Ser. No. 119,063, Nov. 10, 1989, abandoned.

[51] Int. Cl.[5] ..... A47B 81/00

[52] U.S. Cl. ..... 312/409

[58] Field of Search ..... 312/214, 236, 341.1, 312/371; 49/13, 14, 478

[56] References Cited

U.S. PATENT DOCUMENTS

| | | | |
|---|---|---|---|
| 677,734 | 7/1901 | Finkenrath | 312/311 |
| 740,098 | 9/1903 | Davis | 312/311 |
| 1,091,393 | 3/1914 | Schulde et al. | 312/311 |
| 1,176,259 | 3/1916 | Williams | 312/311 X |
| 1,241,104 | 9/1917 | Fleming . | |
| 2,158,217 | 5/1939 | Brisbane . | |
| 2,215,372 | 9/1940 | Haweth | 312/311 X |
| 2,312,325 | 3/1943 | Earle . | |
| 2,312,326 | 3/1943 | Earle . | |
| 2,328,130 | 8/1943 | Earle . | |
| 2,330,339 | 9/1943 | DeMore . | |
| 2,382,084 | 8/1945 | Mathews . | |
| 2,404,851 | 7/1946 | Knowles et al. . | |
| 2,425,232 | 8/1947 | Earle . | |
| 2,444,887 | 7/1948 | Wyeth | 312/236 X |
| 2,455,182 | 11/1948 | La Vallee | 312/333 X |
| 2,471,634 | 5/1949 | Mark et al. | 49/478 X |
| 2,490,494 | 12/1949 | Widman . | |
| 2,578,049 | 12/1951 | Dapprich . | |
| 2,773,362 | 12/1956 | Scheitlin | 312/341 R |
| 2,798,367 | 7/1957 | Earle . | |
| 2,893,805 | 7/1959 | Ferguson . | |
| 2,929,228 | 3/1960 | Gould | 62/382 |
| 3,019,620 | 2/1962 | Costantini et al. . | |
| 3,195,970 | 7/1965 | Chuboff . | |
| 3,254,502 | 6/1966 | Ellis . | |
| 3,364,695 | 1/1968 | Saunders et al. . | |
| 3,364,838 | 1/1968 | Bradley . | |
| 4,317,607 | 3/1982 | Gomolka . | |
| 4,528,558 | 7/1985 | Steers et al. | 49/13 X |
| 4,580,411 | 4/1986 | Orfitelli . | |
| 4,595,247 | 6/1986 | Zank | 312/341 R |
| 4,662,186 | 5/1987 | Park | 62/441 X |

*Primary Examiner*—Joseph Falk
*Attorney, Agent, or Firm*—Wenderoth, Lind & Ponack

[57] ABSTRACT

An upright freezer including a housing having a plurality of openings on one side thereof and a plurality of drawers, each of which is passable through a respective one of the openings. The drawers are supported in the housing by cooperating rollers and rails mounted on respective ones of the drawers and interior side walls of the housing. Each of the openings is closed by an individual door which is pivotally attached to the housing. The doors include a latch or a magnetic seal extending therearound to seal the respective opening in the housing. Alternatively, a latch and a magnetic seal can be provided on each of the doors. The housing also includes apparatus for maintaining the interior of the housing at a temperature below freezing. Each of the doors can include a tab holder thereon for holding a label which indicates the contents of the drawer slidably received within the opening sealed by the respective door. A light is provided on the housing to indicate when any of the doors is in the opened condition.

27 Claims, 1 Drawing Sheet

FREEZER HAVING INDIVIDUAL PULL-OUT DRAWERS

This application is a continuation of now abandoned application, Ser. No. 07/119,063, filed on Nov. 10, 1987.

BACKGROUND OF THE INVENTION

1. Field of the Invention

The present invention relates to a freezer having a plurality of pull-out drawers located on one side thereof for allowing easy access to items located in the individual drawers while saving energy which would otherwise be lost if the freezer had only one drawer.

2. Description of the Prior Art

Currently available freezers generally have one large door which results in large energy losses when the door is open to search for frozen items in the freezer. Most freezers include a shelf in a compartment therein and shelves are usually provided on the door. Disadvantages associated with such freezers include energy loss when searching for specific items within the freezer, discomfort to a person searching through the freezer compartment for specific items and inconvenience in defrosting such freezers if they are not frost-free since all the items must be unloaded from the freezer compartment in order to defrost or clean the freezer.

Refrigerators having more than one drawer are known in the art. For example, U.S. patents which disclose a refrigerator cabinet housing containing a plurality of drawers include Earle (U.S. Pat. Nos. 2,798,367; 2,312,325; 2,312,326; 2,328,130; and 2,425,232), Ferguson (U.S. Pat. No. 2,893,805), Gould, Jr. (U.S. Pat. No. 2,929,228), Knowles et al. (U.S. Pat. No. 2,404,851), Saunders et al. (U.S. Pat. No. 3,364,695), Bradley (U.S. Pat. No. 3,364,838), Gomolka (U.S. Pat. No. 4,317,607) and Park (U.S. Pat. No. 4,662,186). A problem with each of the refrigerators disclosed in these patents is that while the drawers may be removed for purposes such as finding an item therein, cleaning the drawer, loading or unloading of the drawer, once the drawer has been removed from the refrigerator housing, there is no way to prevent the loss of energy from the refrigerator since the opening through which the drawer is removed is left open.

It is also known in the art to provide refrigeration cabinets with a plurality of hinged doors. For instance, U.S. patents disclosing such an arrangement inlcude Fleming (U.S. Pat. No. 1,241,104), Brisbane (U.S. Pat. No. 2,158,217), De More (U.S. Pat. No. 2,330,339) and Dapprich (U.S. Pat. No. 2,578,049). Of these patents, only Dapprich relates to a freezing type apparatus and in particular, the refrigeration device disclosed therein is removably mounted in an existing refrigerator to extend the freezer space thereof. Thus, each of these references fail to teach or suggest a freezer compartment having a plurality of pull-out drawers slidably received in compartments of the freezer, each of which are sealed by an individual hinged door.

Refrigeration devices which include a housing having hinged doors and one or more pull-out drawers which are slidably received in the refrigeration devices include Widman (U.S. Pat. No. 2,490,494), Costantini et al. (U.S. Pat. No. 3,019,620), Chuboff (U.S. Pat. No. 3,195,970), Ellis (U.S. Pat. No. 3,254,502) and Orfitelli (U.S. Pat. No. 4,580,411). However, none of these patents teach or suggest the novel structure of the freezer according to the present invention.

A quick freezing apparatus having hinged doors and removable trays in each of the compartments covered by the hinged doors is disclosed by Mathews (U.S. Pat. No. 2,382,084). The quick freezing apparatus disclosed by Mathews includes an enclosing casing, the front side of which includes a number of hinged doors for access to each separate compartment and at the sides of the casing are hinged doors for defrosting purposes and the compartments are spaced inwardly of the inner surfaces of the casing such that an air cooling supply passage extends along one sidewall of the casing and a return passage extends along the other sidewall of the casing, openings being provided into and out of each compartment with means being provided to open or close the inlets into each compartment. Although the quick freezing apparatus of Mathews allows selective closing of any compartment from the circulation of cooling air for loading or discharging material therefrom with a minimum loss of the cooling effect or cooling medium, this quick freezing apparatus is complicated in structure and does not effectively utilize the space within the freezing compartment. The device according to the present invention overcomes the disadvantages of the quick freezing apparatus of Mathews.

Another device related to the present invention includes La Vallee (U.S. Pat. No. 2,455,182) wherein a light is disclosed for indicating when a drawer of a refrigerator is in the opened condition. Finally, Guibert (U.S. Pat. No. 4,339,928) discloses a freezing unit wherein the frame thereof is fabricated of stainless steel or other easily cleaned material suitable for food handling.

SUMMARY OF THE INVENTION

An object of the present invention is to provide an upright freezer which will save energy when looking for an item stored in the freezer or when the freezer is unloaded for defrosting or cleaning thereof.

A further object of the present invention is to provide an upright freezer having a plurality of pull-out drawers slidably received in respective compartments in a freezer housing, each of the compartments being sealed by a hinged door. To load or unload each compartment of the freezer, one simply removes the entire drawer therefrom and closes the hinged door to seal the compartment. This allows easy cleaning or defrosting of each individual drawer, easy access to any item in the drawer and quick loading and unloading of the drawer.

Another object of the present invention is to provide an upright freezer having a plurality of pull-out drawers slidably received in respective compartments sealed by hinged doors, each of which includes an identification tab on the exterior thereof to indicate the particular types of items located in each of the compartments.

A further object of the present invention is to provide an upright freezer having pull-out drawers with Teflon rollers attached thereto which are slidably received on frame members mounted within the interior of the upright freezer. Additionally, a magnetic seal is provided around each door and/or a latch can be provided on each door to maintain it in a closed condition. Furthermore, one or more indicator lights can be provided on the exterior of the upright freezer for indicating when an individual door is not in the closed position.

The upright freezer according to the present invention allows more effective use of the storage space therein since the pull-out drawers have an end thereof in close proximity to the inner surface of the respective door. Thus, the pull-out drawers utilize the space which would otherwise be occupied by shelves on a conventional freezer door.

BRIEF DESCRIPTION OF THE DRAWINGS

The present invention will be described with reference to the accompanying drawings, in which.

DESCRIPTION OF THE PREFERRED EMBODIMENTS

Figure 1:
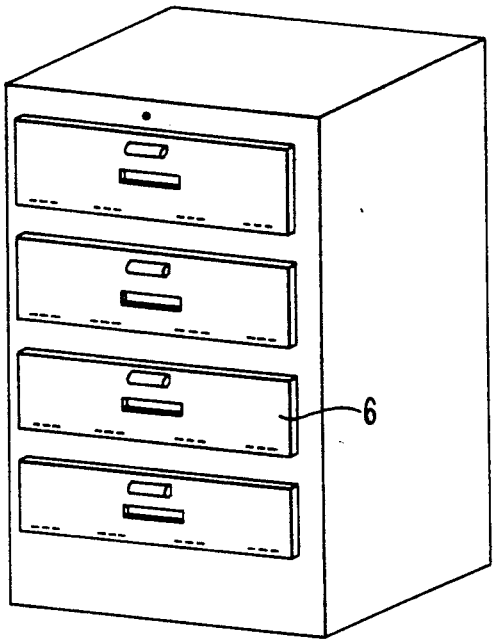
FIG. 1 is a perspective view of an upright freezer according to the invention.
Figure 2:
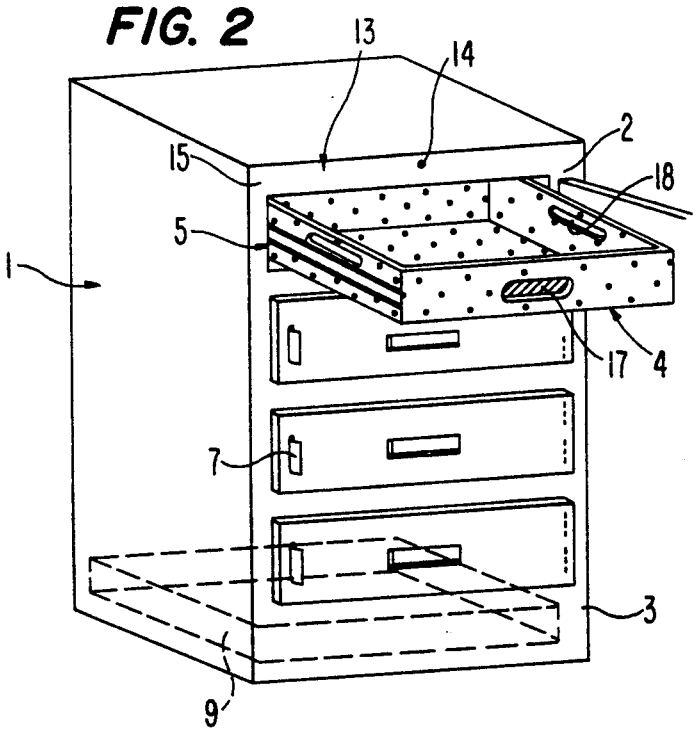
FIG. 2 is a perspective view of a modified version of freezer shown in FIG. 1 with a pull-out drawer partly removed from a compartment therein.
Figure 3:
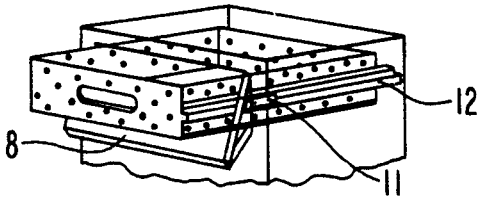
FIG. 3 is a fragmentary perspective view of the freezer shown in FIG. 1 with a drawer partly removed from a compartment in the freezer and supportable by suitable means such as cooperating rollers and rails.

The upright freezer according to the present invention is shown in FIGS. 1-3 and comprises a housing 1 having a plurality of openings 2 on one side 3 thereof. A plurality of drawers 4 are provided which are passable through each respective opening 2. The housing 1 and each drawer 4 include means 5 associated therewith for supporting each of the drawers 4 in the housing 1 inwardly of the openings 2. A plurality of doors 6 are provided, each of which seals a respective one of the openings when in a closed position. The doors 6 are pivotally attached to the housing 1 and include means 7, 8 for sealing each respective one of the openings 2 when the doors 6 are in the closed position. Furthermore, the housing 1 includes means 9 for maintaining the interior of the housing 1 at a temperature below freezing.

Each of the drawers 4 can comprise a perforated aluminum basket having means 10 thereon to prevent articles stored in the baskets from sticking thereto. The sticking preventing means 10 can comprise a coating of synthetic resin material. Alternatively, other types of coatings providing the desired feature of preventing articles from sticking to the basket can be used instead of a synthetic resin material.

The supporting means 5 for each drawer 4 can comprise rollers 11 mounted on one of the drawer 4 and the interior of the housing 1 and at least one rail 12 mounted on the other of the drawer 4 and the interior of the housing 1. The rollers 11 can be of synthetic resin material such as Teflon and the rails 12 can be of stainless steel. Of course, any suitable material can be used for the rollers and rails. In the particular embodiments shown in the figures, the supporting means 5 comprises rollers 11 mounted on opposite sides of the drawers 4 and rails 12 mounted on opposite interior side- walls of the housing 1. In an alternative construction, the rollers 11 can be mounted on the opposite interior sidewalls of the housing 1 and the rails 12 can be mounted on the opposite sides of the drawers 4.

The sealing means 7, 8 can comprise a latch 7 on each of the doors 6 which is engageable with a respective catch disposed on the housing 1 adjacent each of the openings 2. Alternatively, the sealing means 7, 8 can comprise a magnetic seal 8 extending around each of the openings 2 and around each of the doors 6. It is also possible to combine the latch 7 and magnetic seal 8 to form the sealing means 7, 8. In this case, a magnetic seal 8 will extend around each of the openings 2 and around each of the doors 6 and furthermore, a latch 7 will be provided on each of the doors 6 which is engageable with a respective catch disposed on the housing 1 adjacent each of the openings 2.

The freezer of the present invention can further include indicating means 13 for indicating when a respective one of doors 6 is in an opened condition. In particular, the indicating means can comprise a light 14 and sensor means 15 for detecting when a respective one of the doors is in the opened condition and for illuminating the light 14 when the opened condition is detected.

Another feature of the present invention is that the doors 6 are pivotally attached to the housing 1 by means of hinges located along one edge of the doors. In the embodiment shown in FIG. 1, the doors 6 are hinged to the housing 1 along the bottom edge thereof. In an alternative embodiment (see FIG. 2), each of the doors 6 is hinged to the housing 1 along a side edge of each of the doors 6. Of course, the hinges can be located on either the right or left sides of the doors 6 depending on the desired direction of opening of the doors 6.

Another useful feature of the present invention includes labeling means 16 provided on each of the doors 6. The labeling means allows quick identification of the types of articles stored in each of the drawers 4. In the particular embodiment shown in the figures, the labeling means 16 comprises a tab holder for a label on each of the doors 6.

As mentioned earlier, each of the drawers 4 can comprise a coated aluminum basket. Preferably, the drawers comprise perforated baskets having a thickness of 1/16 to $\frac{1}{8}$ inch with $\frac{3}{4}$ inch diameter holes therein. The holes can be provided by stamping the sheet metal comprising the aluminum, baskets. The drawers also include an elongated handle opening 17 formed through the front wall of the basket and optionally grasping means comprising elongated opening 18 formed through each of the sidewalls extending from the front side thereof, as shown in FIG. 2.

While the present invention has been described with reference to the foregoing embodiments, it is to be understood that many changes and modifications may be made thereto which fall within the scope of the appended claims.

What is claimed is:

1. A freezer comprising:

a housing having a plurality of openings on one side thereof;

a plurality of drawers with the total number of drawers being equal to the total number of said openings, each of said drawers being passable through a respective one of said openings, each of said drawers comprising a perforated basket, said basket comprising a bottom wall, two opposing side walls extending upwardly from said bottom wall a front wall extending upwardly from said bottom wall and extending between said two side walls, and a rear wall extending upwardly from said bottom wall and extending between said two side walls in opposing relation to said front wall, each of said bottom wall, said two side walls, said front wall and said rear wall of said basket having a plurality of holes therethrough for circulation of air at temperatures below freezing in and around said basket;

a plurality of doors, each of which covers a respective one of said openings when in a closed position, said doors being pivotally attached to said housing and including means for sealing a respective one of said openings when each of said doors is in said closed position; and means for maintaining an interior of said housing at a temperature below freezing.

2. The freezer of claim 1, wherein each of said drawers includes a handle defined by an elongated handle opening formed through said front wall of said basket.

3. The freezer of claim 2, wherein said elongated handle opening is substantially horizontal.

4. The freezer of claim 3, further comprising indicating means for indicating when a respective one of said doors is in an opened condition, said indicating means comprising a light and sensor means for detecting when a respective one of said doors is in said opened condition and for illuminating said light when said opened condition is detected; and said sealing means comprising a latch on each of said doors engageable with a respective catch disposed on said housing adjacent a respective one of said openings and said sealing means also comprising a magnetic seal extending around each of said openings and around each of said doors.

5. The freezer of claim 4, wherein said basket is formed of aluminum.

6. The freezer of claim 1, further comprising grasping means for grasping each of said drawers, said grasping means comprising a pair of elongated grasping openings formed respectively through each of said two opposing side walls of said basket.

7. The freezer of claim 6, further comprising indicating means for indicating when a respective one of said doors is in an opened condition, said indicating means comprising a light and sensor means for detecting when a respective one of said doors is in said opened condition and for illuminating said light when said opened condition is detected; and said sealing means comprising a latch on each of said doors engageable with a respective catch disposed on said housing adjacent a respective one of said openings and said sealing means also comprising a magnetic seal extending around each of said openings and around each of said doors.

8. The freezer of claim 7, wherein each of said drawers includes a handle defined by an elongated substantially horizontal opening formed through said front wall of said basket.

9. The freezer of claim 8, wherein said basket is formed of aluminum.

10. The freezer of claim 1, further comprising indicating means for indicating when a respective one of said doors is in an opened condition, said indicating means comprising a light and sensor means for detecting when a respective one of said doors is in said opened condition and for illuminating said light when said opened condition is detected.

11. The freezer of claim 1, wherein said sealing means comprises a latch on each of said doors engageable with a respective catch disposed on said housing adjacent a respective one of said openings and said sealing means also comprising a magnetic seal extending around each of said openings and around each of said doors.

12. The freezer of claim 1, wherein said basket includes means thereon to prevent articles stored in said basket from sticking thereto.

13. The freezer of claim 12, wherein said sticking preventing means comprises a coating of synthetic resin material.

14. The freezer of claim 1, wherein said doors are pivotally attached to said housing by hinges located along one edge of each of said doors, respectively.

15. The freezer of claim 1, wherein each of said doors includes labeling means thereon for indicating types of articles stored in each of said drawers.

16. The freezer of claim 15, further comprising said labelling means comprises a tab holder for a label on each of said doors.

17. A freezer comprising:

a housing having a plurality of openings on one side thereof;

a plurality of drawers with the total number of drawers being equal to the total number of said openings, each of said drawers being passable through a respective one of said openings, each of said drawers comprising a perforated basket, said basket comprising a bottom wall, a front wall and two opposing side walls extending upwardly from said bottom wall, each of said bottom wall and side walls of said basket having a plurality of holes therethrough for circulation of air at temperatures below freezing in and around said basket, each of said drawers including a handle defined by an elongated opening formed through said front wall of said basket;

a plurality of doors, each of which covers a respective one of said openings when in a closed position, said doors being pivotally attached to said housing and including means for sealing a respective one of said openings when each of said doors is in said closed position; and means for maintaining an interior of said housing at a temperature below freezing.

18. The freezer of claim 17, further comprising grasping means for grasping each of said drawers, said grasping means comprising a pair of elongated grasping openings formed respectively through each of said two opposing side walls of said basket.

19. The freezer of claim 18, further comprising means for removably supporting each of said drawers in said housing inwardly of said openings, said supporting means for each said drawer comprising rollers mounted on one of said drawers and said interior of said housing and at least one rail mounted on the other of said drawers and said interior of said housing;

indicating means for indicating when a respective one of said doors is in an opened condition, said indicating means comprising a light and sensor means for detecting when a respective one of said doors is in said opened condition and for illuminating said light when said opened condition is detected; and wherein said sealing means comprises a latch on each of said doors engageable with a respective catch disposed on each housing adjacent a respective one of said openings and said sealing means also comprises a magnetic seal extending around each of said openings and around each of said doors.

20. The freezer of claim 19, wherein said basket is formed of aluminum.

21. The freezer of claim 19, wherein said rollers are of synthetic resin material and said rails are of stainless steel.

22. The freezer of claim 17, wherein said doors are pivotally attached to said housing by hinges located along an edge of each of said doors.

23. The freezer of claim 17, wherein each of said doors includes labeling means thereon for indicating types of articles stored in each of said drawers.

24. The freezer of claim 23, wherein said labelling means comprises a tab holder for a label on each of said doors.

25. The freezer of claim 17, wherein said basket includes means thereon to prevent articles stored in said basket from sticking thereto.

26. The freezer of claim 25, wherein said sticking preventing means comprises a coating of synthetic resin material.

27. A freezer comprising:

a housing having a plurality of openings on one side thereof;

a plurality of drawers with the total number of drawers being equal to the total number of said openings, each of said drawers being passable through a respective one of said openings, each of said drawers comprising a perforated basket, said basket comprising a bottom wall, a front wall and two opposing side walls extending upwardly from said bottom wall, each of said bottom wall and side walls of said basket having a plurality of holes therethrough for circulation of air at temperatures below freezing in and around said basket;

a plurality of doors, each of which covers a respective one of said openings when in a closed position, said doors being pivotally attached to said housing and including means for sealing a respective one of said openings when each of said doors is in said closed position;

grasping means for grasping each of said drawers, said grasping means comprising a pair of elongated grasping openings formed respectively through each of said two opposing side walls of said basket;

means for maintaining an interior of said housing at a temperature below freezing;

wherein each of said drawers includes a handle defined by an elongated substantially horizontal opening formed through said front wall of said basket; and wherein a plurality of holes are formed through said front wall of said basket for circulation of air at temperatures below freezing in and around said basket.

* * * * *